US010473318B2

(12) United States Patent
Devappa et al.

(10) Patent No.: US 10,473,318 B2
(45) Date of Patent: Nov. 12, 2019

(54) LED FIXTURE WITH AIR GAP AND HEAT DISSIPATION

(71) Applicant: Appleton Grp LLC, Rosemont, IL (US)

(72) Inventors: Harsha N. Devappa, Pune (IN); Anoop R. Zutti, Karnataka (IN); Dawn M. Grandsart, Chicago, IL (US); Chethan S B, Pin (IN); Timothy E. Graff, Arlington Heights, IL (US)

(73) Assignee: Appleton Grp LLC, Rosemont, IL (US)

( * ) Notice: Subject to any disclaimer, the term of this patent is extended or adjusted under 35 U.S.C. 154(b) by 0 days.

(21) Appl. No.: 15/950,653

(22) Filed: Apr. 11, 2018

(65) Prior Publication Data

US 2019/0203924 A1 Jul. 4, 2019

(30) Foreign Application Priority Data

Jan. 4, 2018 (IN) ..... 201821000445

(51) Int. Cl.

| | |
|---|---|
| ***F21V 29/77*** | (2015.01) |
| ***F21V 29/503*** | (2015.01) |
| ***F21V 23/00*** | (2015.01) |
| ***F21V 15/01*** | (2006.01) |
| ***F21V 29/508*** | (2015.01) |
| ***F21V 17/12*** | (2006.01) |
| *F21Y 115/10* | (2016.01) |

(52) U.S. Cl.
CPC ..... *F21V 29/773* (2015.01); *F21V 15/01* (2013.01); *F21V 17/12* (2013.01); *F21V 23/009* (2013.01); *F21V 29/503* (2015.01); *F21V 29/508* (2015.01); *F21Y 2115/10* (2016.08)

(58) Field of Classification Search
CPC ..... F21V 29/773
See application file for complete search history.

(56) References Cited

U.S. PATENT DOCUMENTS 8,246,202 B2 * 8/2012 Mart ..... F21K 9/233 362/249.01
8,362,677 B1 * 1/2013 Morejon ..... F21V 29/004 313/46

(Continued)

OTHER PUBLICATIONS

International Searching Authority, Written Opinion issued in PCT/US2019/012360 dated Apr. 1, 2019, 14 pages.

*Primary Examiner* — Sean P Gramling
*Assistant Examiner* — Keith G. Delahoussaye
(74) *Attorney, Agent, or Firm* — McDonnell Boehnen Hulbert & Berghoff LLP

(57) ABSTRACT

An LED fixture (200) that facilitates effective heat dissipation of an array of LEDs, having improved thermal performance; and is easy to mount or dismount. The LED fixture (200) includes a heat sink (202) having a hollow configuration, and a plurality of fins (204) extending circumferentially and outwardly from the heat sink (202). The LED fixture (200) further comprises a base (206) configured at an operative bottom portion of the heat sink (202), and a driver housing (208) connected to an operative top surface of the heat sink (202). The base (206) is configured to support an array of LEDs. The driver housing (208) is configured to accommodate a plurality of LED drivers. The driver housing (208) and the base (206) are arranged in a spaced apart configuration.

9 Claims, 5 Drawing Sheets

(56) References Cited

U.S. PATENT DOCUMENTS

| | | | | |
|---|---|---|---|---|
| 2005/0174780 | A1* | 8/2005 | Park | F21V 3/02 362/294 |
| 2009/0135613 | A1* | 5/2009 | Peng | F21K 9/233 362/373 |
| 2009/0141508 | A1* | 6/2009 | Peng | F21V 23/02 362/373 |
| 2009/0237940 | A1* | 9/2009 | Wu | F21K 9/233 362/280 |
| 2010/0103675 | A1* | 4/2010 | Yu | F21V 29/773 362/253 |
| 2010/0164348 | A1* | 7/2010 | Huang | F21V 15/01 313/46 |
| 2011/0044050 | A1* | 2/2011 | Chiu | F21V 25/00 362/294 |
| 2011/0109217 | A1* | 5/2011 | Kang | F21V 29/004 313/46 |
| 2011/0194280 | A1 | 8/2011 | Ruffin, Jr. et al. | |
| 2011/0242828 | A1 | 10/2011 | Blincoe et al. | |
| 2012/0087121 | A1* | 4/2012 | Yang | F21V 3/02 362/235 |
| 2012/0281409 | A1* | 11/2012 | Patkus | F21V 23/003 362/249.02 |
| 2016/0053982 | A1* | 2/2016 | Kovalchick | F21V 23/009 362/238 |
| 2016/0377233 | A1* | 12/2016 | Kwong | F21V 1/00 362/294 |
| 2018/0038583 | A1* | 2/2018 | Shi | F21V 29/77 |

* cited by examiner

LED FIXTURE WITH AIR GAP AND HEAT DISSIPATION

RELATED APPLICATIONS

This application claims priority to Indian Application No. 201821000445 entitled "An LED Fixture" filed on Jan. 4, 2018, the contents of which are incorporated by reference herein in their entirety.

FIELD

The present disclosure relates to the field of light fixtures. Particularly, the present disclosure relates to the field of LED fixtures.

Definitions

Globe—The term "globe" hereinafter in the complete specification refers to a protective transparent cover provided for LEDs through which the light generated by the LEDs passes.

BACKGROUND

Light sources, such as LEDs, have relatively high operating temperatures. In order to increase the overall lighting brightness, a plurality of LEDs is often incorporated into a single lamp, which generates a high amount of heat. Conventionally, the heat generated by the LED lights is dissipated by providing an enclosure that includes a housing with a plurality of fins extending therefrom. The LEDs are fitted on a heat sink puck within the housing. On the opposite side of the heat sink puck, LED drivers are mounted. Any increase in temperature of the LEDs increases the temperature of the drivers. Further, as the LEDs and the drivers are mounted on the same heat sink puck, the heat dissipation capacity of the enclosure is reduced. Further, absence of any thermal barrier between the drivers and the LEDs reduces the efficiency of the LEDs and performance of the drivers. Moreover, the heat dissipation efficiency of the enclosure substantially decreases as the heat dissipation is not uniform.

Therefore, there is felt a need for an LED fixture that alleviates the abovementioned drawbacks of the conventional LED fixture.

Objects

Some of the objects of the present disclosure, which at least one embodiment herein satisfies, are as follows:

An object of the present disclosure is to provide an LED fixture that facilitates effective heat dissipation of an array of LEDs.

Another object of the present disclosure is to provide an LED fixture that has improved thermal performance.

Yet another object of the present disclosure is to provide an LED fixture that is easy to mount or dismount.

Other objects and advantages of the present disclosure will be more apparent from the following description, which is not intended to limit the scope of the present disclosure.

SUMMARY

The present disclosure envisages an LED fixture. The LED fixture comprises a heat sink, a plurality of fins, a base, and a driver housing. The heat sink has a hollow configuration. In an embodiment, the heat sink is bowl shaped. The plurality of fins extends circumferentially from the heat sink, wherein each of the fins has chamfered edges. The base is configured at an operative bottom portion of the heat sink to support an array of LEDs. The driver housing is connected to an operative top surface of the heat sink, and is configured to accommodate a plurality of LED drivers. The driver housing and the base are arranged in a spaced apart configuration.

The LED fixture further comprises a collar and a globe. The collar extends in an operative downward direction from the base. The globe is threadably connected to the collar. Further, a protective guard member is connected to the heat sink to protect the globe.

Further, a drain hole is configured on said driver housing to drain the water accumulated on an operative top surface of the driver housing.

In an embodiment, the driver housing is connected to the heat sink via a plurality of fasteners.

In another embodiment, the driver housing includes a plurality of mounting extensions for facilitating mounting or suspension of the LED fixture.

BRIEF DESCRIPTION OF THE ACCOMPANYING DRAWING

An LED Fixture, of the present disclosure, will now be described with the help of the accompanying drawing, in which.

LIST OF REFERENCE NUMERALS USED IN DETAILED DESCRIPTION AND DRAWING

100—Conventional LED fixture
102—Housing
104—Plurality of fins
106—Heat sink puck
108—Globe
200—LED fixture
202—Heat sink
204—Plurality of fins
206—Base
208—Driver housing
210—Collar
212—Globe
214—Drain hole
215—90° Elbow
216—Mounting extensions
218—Bottom surface of the driver housing
220, 222, 224—Gasket
226—Cover

228—Space between the driver housing 208 and the base 206

DETAILED DESCRIPTION

Figure 1A:
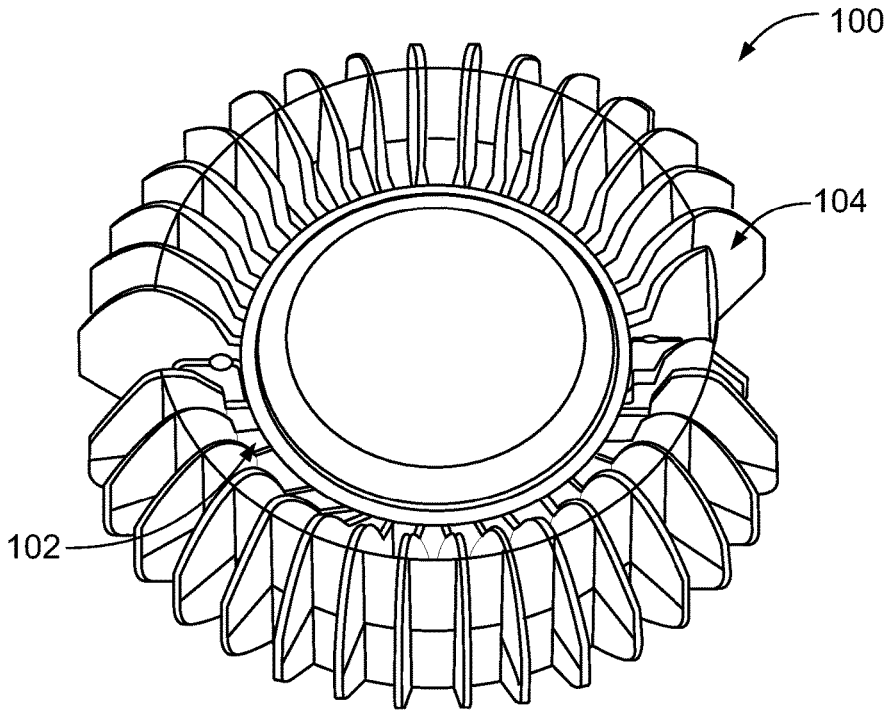
FIG. 1A PRIOR ART
FIG. 1A illustrates an isometric view of a conventional LED fixture.
Figure 1B:
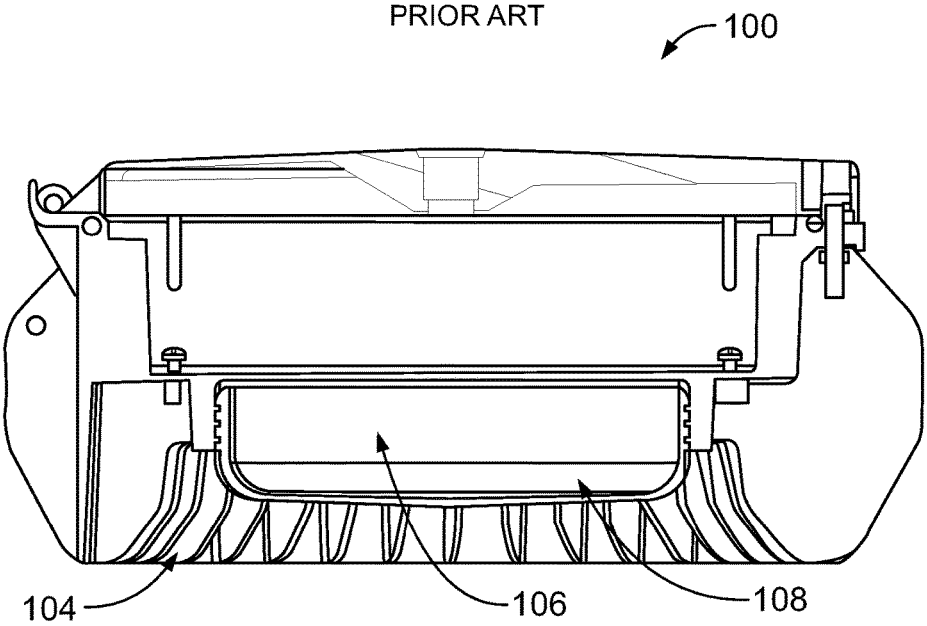
FIG. 1B PRIOR ART
FIG. 1B illustrates a front view of the conventional LED fixture of FIG. 1A.
Figure 1C:
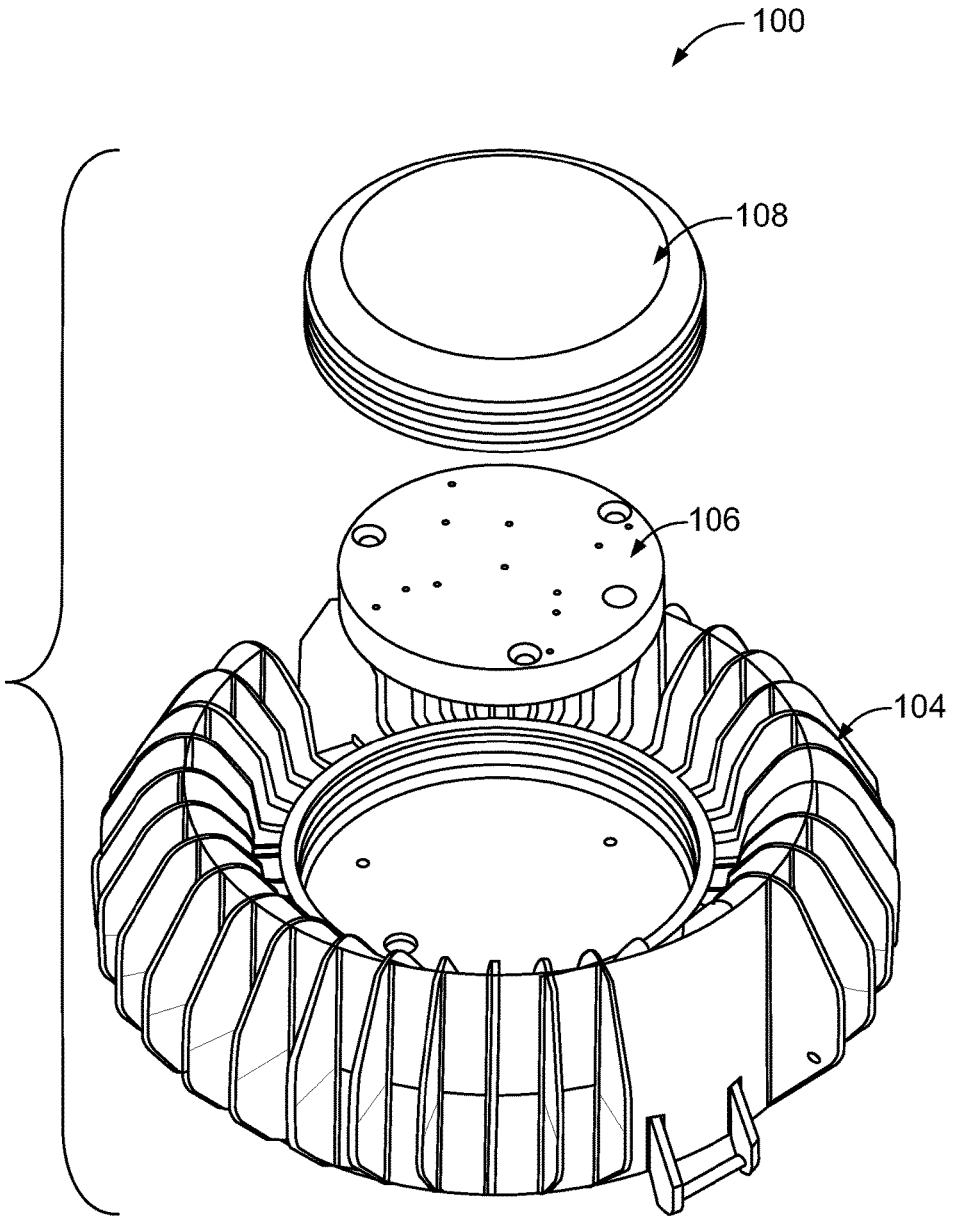
FIG. 1C PRIOR ART
FIG. 1C illustrates an exploded view of the conventional LED fixture of FIG. 1A.

FIG. 1A, FIG. 1B, and FIG. 1C illustrate an isometric view, a front view, and an exploded view of a conventional LED fixture 100 (hereinafter also referred to as fixture 100) respectively. The fixture 100 comprises a housing 102, a heat sink puck 106, and a globe 108. The housing 102 has a plurality of fins 104 extending therefrom. The housing 102 has a hollow configuration. Further, the heat sink puck 106 is fitted within the housing 102. An array of light emitting diodes (hereinafter also referred to as LEDs) is fitted on one side of the heat sink puck 106. On the opposite side of the heat sink puck 106, a plurality of LED drivers (not shown in figures) are mounted. A cover (not exclusively labelled in figures) is provided on the top of the housing 102. Further, all the connectors and terminal blocks are housed within the housing 102. The array of LEDs is mounted on the heat sink puck 106 using a thermal interface compound. The globe 108 is connected to the heat sink puck 106. During operation, the array of LEDs generates a large amount of heat which increases the temperature of the LEDs. The heat generated by the LEDs within the housing 102 is removed via the heat sink puck 106 and the plurality of fins 104. However, there is a gap formed between the heat sink puck 106 and the housing 102. This gap adds resistance to the heat flow, thereby reducing the heat removal from the LED array. The reduction in heat removal increases the temperature of the LED array. As both the LED array and the driver are mounted on the same heat sink puck 106, an increase in temperature of the LED array also increases the temperature of the drivers. If the driver temperature rises above a certain limit, the driver stops functioning and the array of LEDs fails. Further, the conventional LED fixture does not have different light distribution patterns.

Typically, a maximum operating temperature of the LEDs is 150° Celsius. If LEDs are operated above the operating temperature, it can cause permanent damage to the LEDs.

Therefore, there is felt a need for an LED fixture that alleviates the abovementioned drawbacks of conventional LED fixtures and effectively dissipates the heat generated by LEDs and drivers.

Figure 2:
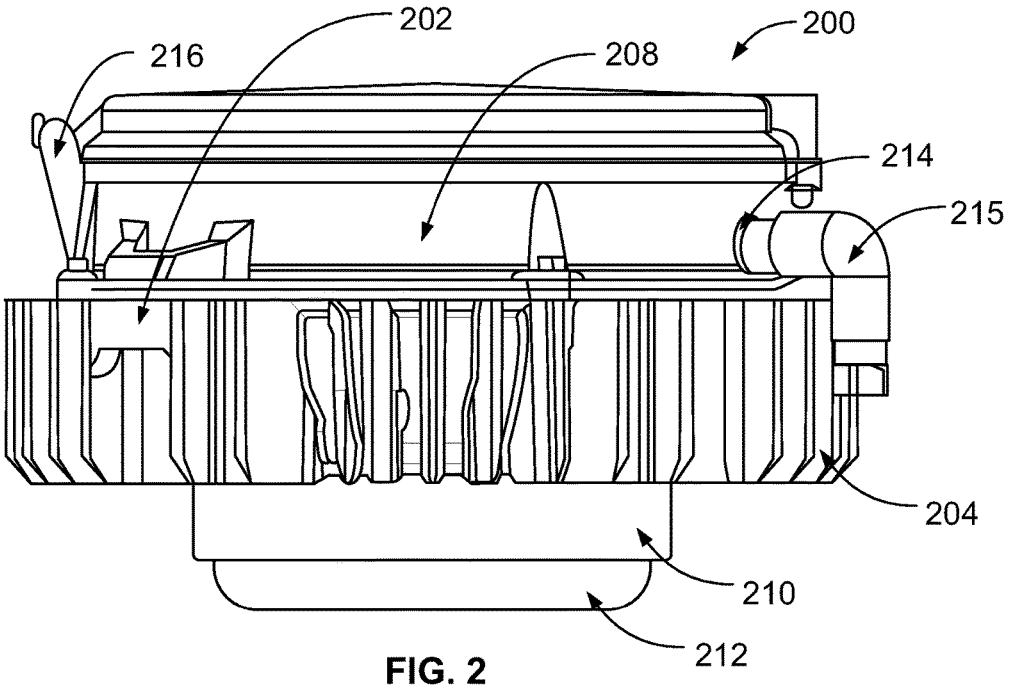
FIG. 2 illustrates a front view of a LED fixture, in accordance with an embodiment of the present disclosure.
Figure 3:
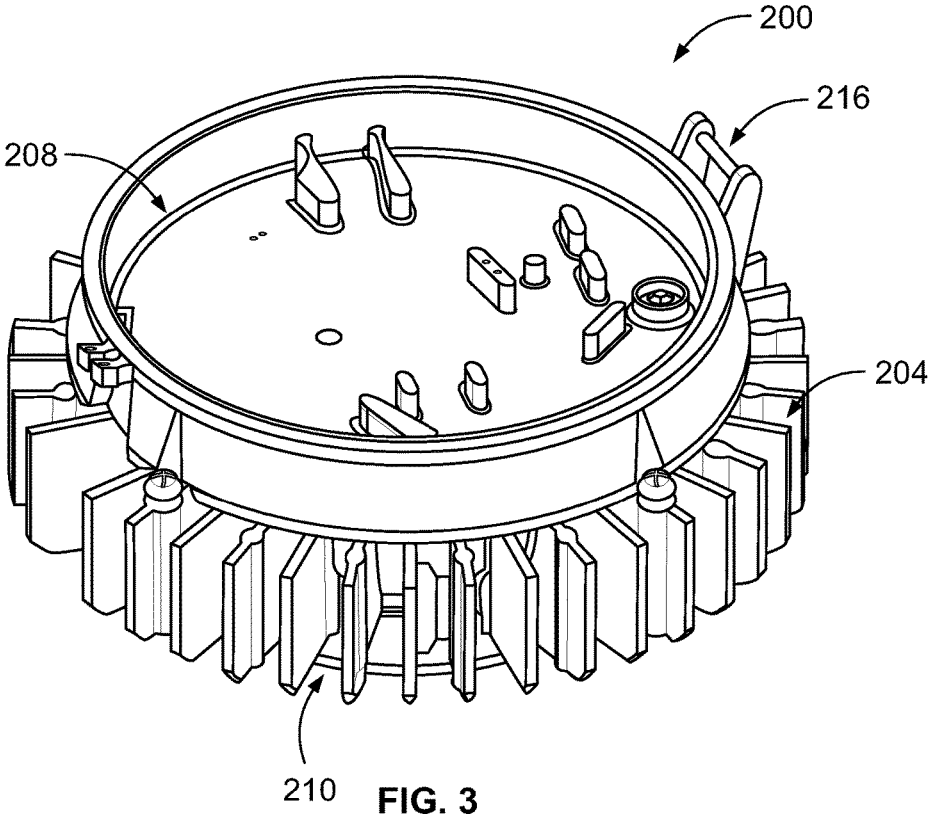
FIG. 3 illustrates an isometric view of the LED fixture of FIG. 2.
Figure 4:
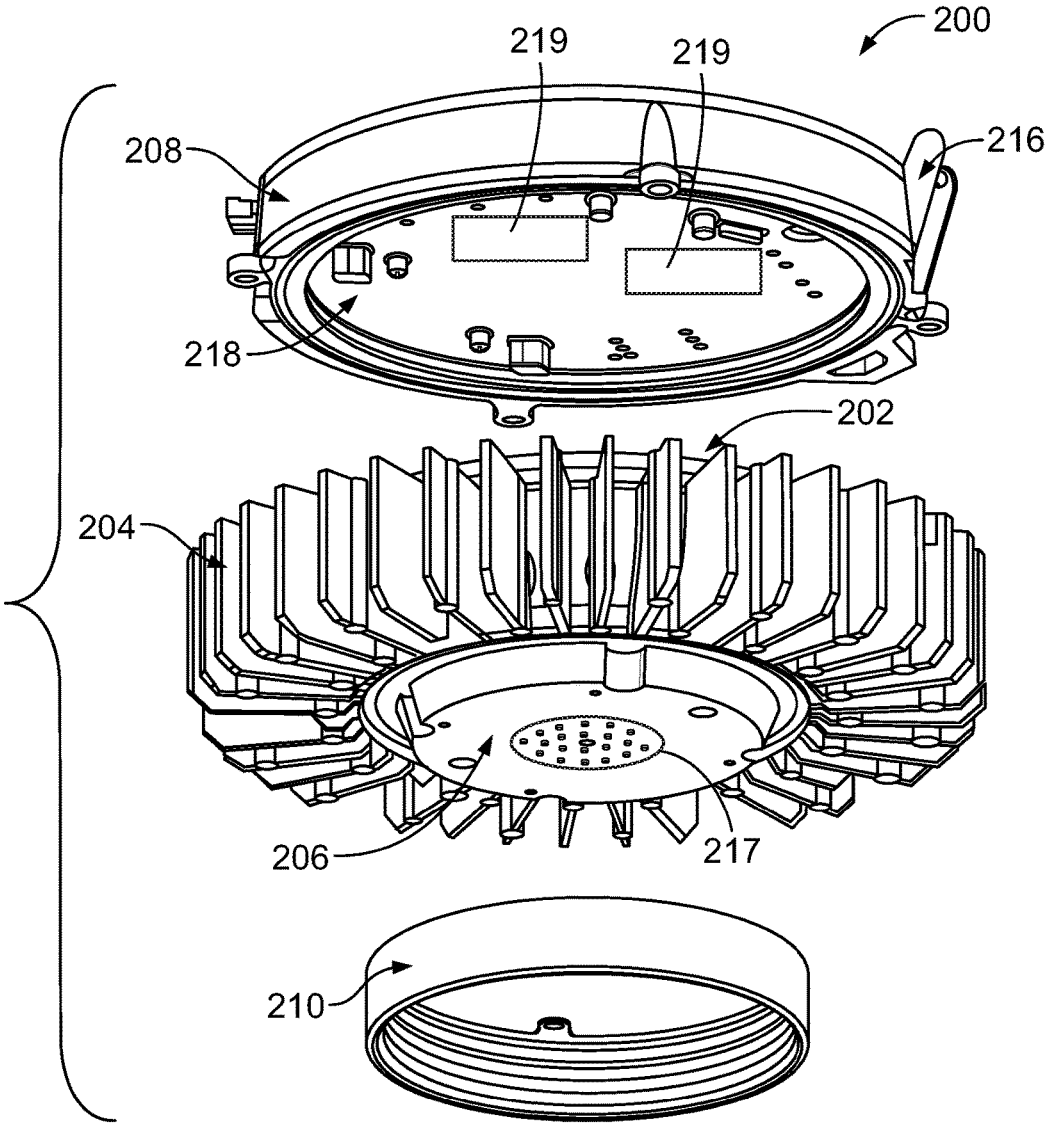
FIG. 4 illustrates an exploded view of the LED fixture of FIG. 2.
Figure 5:
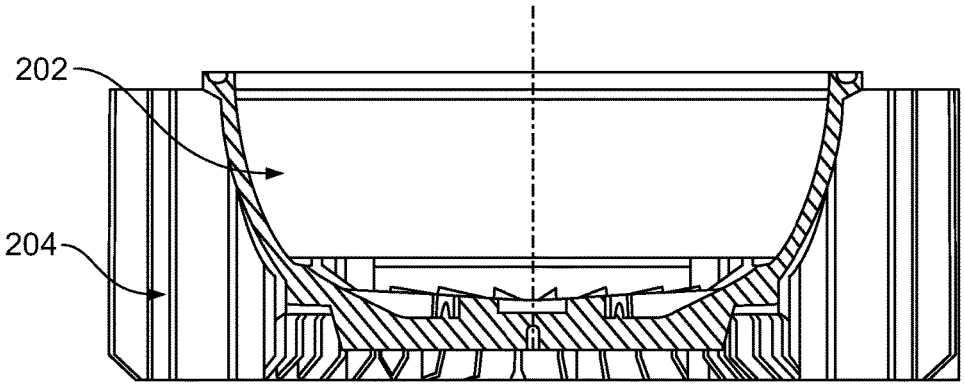
FIG. 5 illustrates a cross-sectional view of a heat sink of the LED fixture of FIG. 2.
Figure 6:
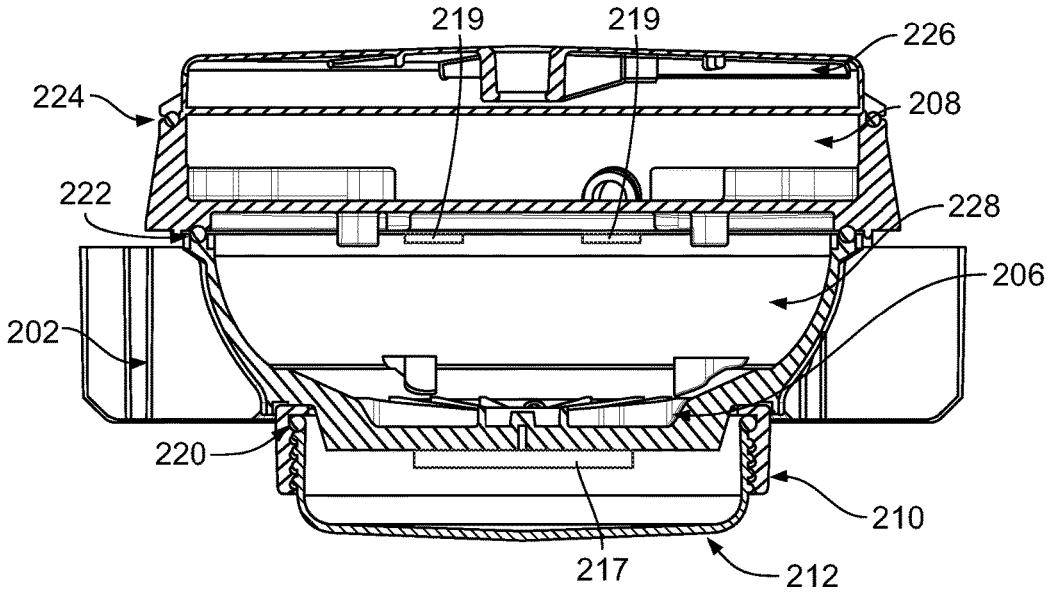
FIG. 6 illustrates a cross-sectional view of the LED fixture of FIG. 2.

The LED fixture of the present disclosure hereinafter described with reference to FIG. 2 through FIG. 6. FIG. 2 illustrates a front view of an LED fixture 200, in accordance with an embodiment of the present disclosure. FIG. 3 illustrates an isometric view of the LED fixture 200. FIG. 4 illustrates an exploded view of the LED fixture 200. FIG. 5 illustrates a cross-sectional view of a heat sink of the LED fixture 200. FIG. 6 illustrates a cross-sectional view of the LED fixture 200.

The LED fixture 200 (hereinafter also referred to as fixture 200) comprises a heat sink 202. The heat sink 202 acts as a housing. The heat sink 202 has a hollow configuration. In an embodiment, the heat sink 202 is bowl shaped.

The fixture 200 further comprises a plurality of fins 204. The fins 204 extend circumferentially and outwardly from the heat sink 202. In an embodiment, the fins 204 have a rectangular cross-section. In another embodiment, the cross-sectional shape of the fins 204 is selected from the group consisting of a rectangle, square, trapezoidal, curved, and any geometrical or non-geometrical shape. The fins 204 are configured circumferentially about the longitudinal axis of the heat sink 202 of the fixture 200 and extend in parallel with the longitudinal axis of the heat sink 202.

The dimensions of the fins 204 are determined in accordance with dimensions of the heat sink 202. In an embodiment, the ratio of a circumference of the heat sink 202 to length of the fins 204 is 1:0.3.

In an exemplary embodiment, the edges of the fins 204 are chamfered. The chamfered edges make the handling of the fixture 200 safer.

The fixture 200 further comprises a base 206 configured at an operative bottom portion of the heat sink 202. The base 206 is configured to support an array of LEDs 217. In an embodiment, the base 206 is made integral with the heat sink 202. The array of LEDs 217 is attached to an operative bottom surface of the base 206.

The fixture 200 further comprises a collar 210 extending in an operative downward direction from the base 206. In an embodiment, the collar 210 has a cylindrical cross section. Internal threads (not shown in figures) are configured on the collar 210. In an embodiment, the collar 210 is made integral with the base 206. In another embodiment, the collar is connected to the base 206 using a plurality of fasteners.

Further, the LED fixture 200 includes a globe 212. The globe 212 is threadably connected to the collar 210 via a gasket 220. The globe 212 has external threads configured thereon which are complementary to the internal threads of the collar 210. The globe 212 is configured to prevent damage to the array of LEDs. In an embodiment, the globe 212 is made of glass, plastic or any other suitable transparent material. The globe 212 can have any suitable shape. In an embodiment, the globe 212 has a hemispherical shape.

The globe 212 facilitates quick access to the array of LEDs during maintenance and replacement of the LEDs, as the globe 212 can be easily removed from the collar 210.

In an embodiment, a protective guard member (not shown in figures) is connected to the heat sink 202 which prevents the globe 212 from damage.

The fixture 200 further comprises a driver housing 208 connected to an operative top surface of the heat sink 202, wherein the driver housing 208 is configured to accommodate a plurality of LED drivers 219. The driver housing 208 is connected to the heat sink 202 via a plurality of fasteners. The driver housing 208 can be easily removed from the heat sink 202 for maintenance. In case the drivers fail to function, the drivers can be replaced.

A cover 226 is connected to an operative top surface of the driver housing 208 via a gasket 224.

The driver housing 208 and the base 206 are arranged in a spaced apart configuration. This arrangement facilitates effective heat dissipation from the array of LEDs. As there is space 228 between the driver housing 208 and the base 206, the increase in the temperature of the LEDs does not materially affect the driver housing 208.

The LED drivers 219 are connected to an operative bottom surface 218 of the driver housing 208. A plurality of holes is configured on the operative bottom surface 218 of the driver housing 208 for facilitating the arrangement and connection of the LED drivers 219 with the array of LEDs 217. In an embodiment, the driver housing 208 is configured to accommodate drivers having different wattages including, but not limited to, 50 Watts, 100 Watts, and 150 Watts. In another embodiment, the driver housing 208 is configured to accommodate connectors, fuse(s), and terminal blocks.

Heat generated by the array of LEDs is dissipated through the heat sink 202 and the fins 204. The fins 204 are configured so as to effectively dissipate heat from the LED array and the heat sink 202. As the fins 204 are distributed over the periphery of the heat sink 202, the heat generated by the array of LEDs gets uniformly dissipated which improves the thermal performance of the fixture 200. The heat dissipated by the fixture 200 is through conduction and convection heat transfer mechanisms.

A drain hole 214 is configured on the driver housing 208 to remove water accumulated on an operative top surface of the driver housing 208. A 90° elbow 215 is connected to the drain hole 214 to carry water from the drain hole 214. In an embodiment, other geometries for the elbow other than 90° can also be used to connect to drain hole 214 to serve as a drain.

In an embodiment, the heat sink 202 and the driver housing 208 are sealably connected to each other via a gasket 222, which prevents ingress of air, water and dust.

Further, the driver housing 208 includes a plurality of mounting extensions 216 for facilitating mounting or suspension of the fixture 200. The plurality of mounting extensions 216 is configured to facilitate generation of various beam patterns by the fixture 200. The beam patterns generated by the fixture 200 include, but not limited to, Type I, Type III, Type V, and Type V wide.

Further, the fixture includes a provision which facilitates tying of the fixture 200 via a cable. Use of the cable provides additional safety to the fixture 200.

In an embodiment, the driver housing 208, the heat sink 202, and the collar 210 are three separate parts configured by a casting process and joined together to form the fixture 200. The fixture 200, with three different components, provides better thermal performance. In an embodiment, the driver housing 208, the heat sink 202, and the collar 210 are made of metal. In another embodiment, the driver housing 208, the heat sink 202, and the collar 210 are made of Aluminium.

In an experimental analysis, it was found that there was 14% reduction in the operating temperature of the LEDs in the fixture 200 as compared to the temperature of LEDs in a conventional fixture. Further, there was 17% reduction in the operating temperature of drivers in the fixture 200 as compared to the temperature of drivers in the conventional fixture. It was also observed that there was 10% reduction in the temperature of the heat sink 202 in the fixture 200 as compared to the temperature of the housing in the conventional fixture. From the above experimental analysis, it is evident that the fixture 200 improves the heat dissipation rate of the drivers and the array of LEDs.

It was observed that there was 25% increase in light output generated by the fixture 200 as compared to the conventional fixtures.

The fixture 200 has an improved heat dissipation rate. The fixture 200 generates high lumen output. In an embodiment, the lumen output that can be obtained by the fixture 200 is more than 16000 lumens. The fixture 200 is easy to install, and provides quick access for maintenance and replacement purposes.

Technical Advancements

The present disclosure described herein above has several technical advantages including, but not limited to, the realization of an LED fixture that:

facilitates effective heat dissipation of an array of LEDs;

has improved thermal performance; and is easy to mount or dismount.

The foregoing disclosure has been described with reference to the accompanying embodiments which do not limit the scope and ambit of the disclosure. The description provided is purely by way of example and illustration.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The foregoing description of the specific embodiments so fully revealed the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the disclosure to achieve one or more of the desired objects or results.

Any discussion of documents, acts, materials, devices, articles or the like that has been included in this specification is solely for the purpose of providing a context for the disclosure. It is not to be taken as an admission that any or all of these matters form a part of the prior art base or were common general knowledge in the field relevant to the disclosure as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

We claim:

1. An LED fixture (200) comprising;

a heat sink (202) having a hollow configuration;

a plurality of fins (204) extending circumferentially from said heat sink (202);

a base (206) configured at an operative bottom portion of said heat sink (202) to support an array of LEDs (212); and a driver housing (208) connected to an operative top surface of said heat sink (202), said driver housing (208) configured to accommodate a plurality of LED drivers (219);

wherein, said driver housing (208) and said base (206) are arranged in a spaced apart configuration, with an air gap positioned between said driver housing (208) and said base (206), wherein said fixture (200) further comprises:

a collar (210), separate from said base (206) is directly connected to said base (206); and a globe (212) threadably connected to said collar (210);

wherein said collar (210) has threads complementary to threads configured on said globe (212); and wherein said driver housing (208) is connected to said heat sink (202) via a plurality of fasteners.

2. The LED fixture (200) as claimed in claim 1, wherein said heat sink (202) is bowl shaped.

3. The LED fixture (200) as claimed in claim 1, wherein a drain hole (214) is configured on said driver housing (208) to drain any accumulated water on an operative top surface of said driver housing (208).

4. The LED fixture (200) as claimed in claim 1, wherein a ratio of a circumference of said heat sink (202) to a length of said plurality of fins (204) is 1:0.3.

5. The LED fixture (200) as claimed in claim 1, wherein each of said plurality of fins (204) has chamfered edges.

6. An LED fixture (200) comprising:

a heat sink (202) having a hollow configuration;

a plurality of fins (204) emending circumferentially from said heat sink (202);

a base (206) configured at an operative bottom portion of said heat sink (202) to support an array of LEDs (217); and a driver housing (208) connected to an operative top surface of said heat sink (202), said driver housing (208) configured to accommodate a plurality of LED drivers (219);

wherein, said driver housing (208) and said base (206) are arranged in a spaced apart configuration, with an air gag positioned between said driver housing (208) and said base (206), wherein said fixture (200) further comprises:

a collar (210) separate from said base (206) is directly connected to said base (206); and a globe (212) threadably connected to said collar (210);

wherein said collar (210) has threads complementary to threads configured on said globe (212); and wherein a first gasket (220) is positioned between said collar (210) and said globe (212).

7. The LED fixture (200) of claim 6, wherein a second gasket (222) is positioned between the base (206) and the driver housing (208).

8. The LED fixture (200) of claim 7, wherein a third gasket (224) is positioned between the driver housing (208) and a cover (226).

9. An LED fixture (200) comprising;

a heat sink (202) having a hollow configuration;

a plurality of fins (204) extending circumferentially from said heat sink (202);

a base (206) configured at an operative bottom portion of said heat sink (202) to support an array of LEDs (217); and a driver housing (208) connected to an operative top surface of said heat sink (202), said driver housing (208) configured to accommodate a plurality of LED drivers (219);

wherein said driver housing (208) and said base (206) are arranged in a spaced apart configuration, with an air gap positioned between said driver housing (208) and said base (206), wherein said fixture (200) further comprises:

a collar (210) separate from said base (206) is directly connected to said base (206); and a globe (212) threadably connected to said collar (210);

wherein said collar (210) has threads complementary to threads configured on said globe (212); and wherein said driver housing (208) includes a plurality of mounting extensions for facilitating mounting or suspension of said LED fixture (200).

* * * * *